US005842844A

United States Patent [19]

Oki et al.

[11] Patent Number: 5,842,844

[45] Date of Patent: Dec. 1, 1998

[54] SCROLL TYPE COMPRESSOR WITH IMPROVED ROTATION PREVENTING MEANS

[75] Inventors: Yasuhiro Oki, Okazaki; Shigeru Hisanaga, Kariya, both of Japan

[73] Assignees: Nippondenso Co., Ltd.; Kabushiki Kaisha Toyoda Jidoshokki Seisakusho, both of Kariya, Japan

[21] Appl. No.: 685,864

[22] Filed: Jul. 24, 1996

[30] Foreign Application Priority Data

Jul. 25, 1995 [JP] Japan ..... 7-189532

[51] Int. Cl.[6] ..... F04C 18/04

[52] U.S. Cl. ..... 418/55.3; 418/55.5; 418/57; 464/137

[58] Field of Search ..... 418/55.3, 55.5, 418/57; 464/102, 137

[56] References Cited

U.S. PATENT DOCUMENTS 4,954,056 9/1990 Muta et al. ..... 418/55.3

FOREIGN PATENT DOCUMENTS 0 652 371 5/1995 European Pat. Off. .
62-199983 9/1987 Japan ..... 418/55.3
1242824 9/1989 Japan ..... 464/137

OTHER PUBLICATIONS

Patent Abstracts of Japan, vol. 12, No. 52.

*Primary Examiner*—John J. Vrablik
*Attorney, Agent, or Firm*—Cushman Darby & Cushman Group of Pillsbury Madison & Sutro LLP

[57] ABSTRACT

A scroll type compressor includes a stationary scroll element, a movable scroll element orbiting about a given axis and cooperating with the stationary scroll element for compressing a fluid in a compression chamber defined between the two scroll elements, and a rotation preventing unit for preventing rotation of the movable scroll element about its own axis. The rotation preventing unit has at least a plurality of pairs of scroll side pins mounted on the movable scroll element and housing side pins mounted on a housing of the compressor. When the compression chamber has a reduced volume of 10 through 22% of an initial volume thereof immediately after completion of sucking of the fluid, at least two of the plurality of scroll side pins are arranged to be symmetrical with one another with respect to a line $L_2$ which passes through a rotating center $O_R$ of the movable scroll element and is perpendicular to a different line $L_1$ which passes through the rotating center $O_R$ of the movable scroll element and an orbiting center $O_S$ of the movable scroll element. The two scroll side pins are also arranged on a leading side to the cooperating housing side pins, respectively, in a direction corresponding to a direction of rotation of the movable scroll element about the rotating center $O_R$.

14 Claims, 5 Drawing Sheets

SCROLL TYPE COMPRESSOR WITH IMPROVED ROTATION PREVENTING MEANS

BACKGROUND OF THE INVENTION

1. Field of the Invention

The present invention generally relates to a scroll type compressor adapted to being incorporated in a climate control system or an air-conditioning system, and more particularly, relates to a rotation preventing means accommodated in a scroll type compressor to prevent a movable scroll element from being rotated about its own axis during the operation of the compressor.

2. Description of the Related Art

Generally, a scroll type compressor includes a stationary scroll element having a fixed base plate and a spiral or wrap element fixed to an end face of the fixed base plate, and a movable scroll element having a base plate and a movable spiral or wrap element fixed to an end face of the base plate. The stationary and movable scroll elements are housed in a housing and engage one another so that the spiral elements of the stationary and movable scroll elements are mutually engaged with one another to define compression chambers in the shape of pockets moving from an outer portion of the stationary and movable scroll elements toward the center of both elements. Namely, when the movable scroll element orbits about the center of the stationary scroll element, the pocket-like compression chambers are gradually shifted from the outer portion of the engaged spiral elements of both stationary and movable scroll elements to the center of both elements so as to compress a fluid which is, typically, a refrigerant gas.

The above-mentioned scroll type compressor is conventionally provided with a rotation preventing means for preventing the movable scroll element from being rotated about its own axis and to permit it to perform an orbiting motion about the center of the stationary scroll element. A typical rotation preventing means is disclosed in Japanese Unexamined Patent Application Publication (Kokai) No. 62-199983, which includes a plurality of pin and ring assemblies, each being provided with a first pin fixedly attached to the base plate of the movable scroll element, a different second pin fixedly attached to an inner wall of the housing confronting the base plate of the movable scroll element, and a ring element fitted around outer ends of the first and second pins. Thus, when the movable scroll element orbits around the central axis of the stationary scroll element, the first pins of the pin and ring assemblies attached to the movable scroll element turn around the second pins attached to the stationary scroll element under the control of the ring element. Thus, the movable scroll element is prevented from being rotated about its own axis, and is permitted to orbit about the center of the stationary scroll element.

When the compressor operates so as to compress the fluid, e.g., a refrigerant gas, a reaction force acts on the movable scroll element. A part of the reaction force applies a moment to the movable element acting to rotate it about its own axis. Therefore, the first and second pins of the rotation preventing means mounted on the movable scroll element and the housing receive a reaction force as a load from the movable scroll element which is proportional to the extent of the moment acting on the movable scroll element. Therefore, for instance, the load might be concentrically applied to one of the pairs of pin and ring assemblies of the rotation preventing means to thereby cause a breakage of the pin and ring assembly. However, if the diameters of the pins of the rotation preventing means are increased so as to increase a mechanical strength thereof, the entire size of the scroll type compressor becomes large. Thus, in order to prevent breakage of the rotation preventing means and to simultaneously reduce the size of the body of the compressor, the rotation preventing means provided with the plurality of pin and ring assemblies must be arranged so that a substantially identical load is applied to respective pin and ring assemblies of the rotation preventing means.

At this stage, according to an experiment conducted by the present inventors, the moment applied to the movable scroll element and causing the rotation of the movable scroll element about its own axis changes to have a single peak value i.e., the maximum value thereof during one complete rotation of a drive or crank shaft of the compressor, as shown in the graph of FIG. 6. For example, when a scroll type compressor was operated under a condition such that a suction and a discharge pressures of the fluid of the compressor were set as 4.0 kgf/cm$^2$ and 30 kgf/cm$^2$, respectively, the maximum value of the moment causing the rotation of the movable scroll element about its own axis occurred when the volume of each of the plurality of compression chambers is reduced to 16% of the initial volume thereof presented immediately after the suction of the fluid. Namely, the maximum value of the moment occurs when the volumetric ratio of each of the compression chambers reaches 16%. Therefore, the present inventors further conducted experiments to detect how the moment causing a rotation of the movable scroll element changes depending upon a change in the suction and discharge pressures of the compressor, and detected that in general, the maximum value of the moment occurs when the volumetric ratio of the compressor is between 10 through 22%.

When the moment changes to the maximum value thereof, the load applied to the rotation preventing means also becomes the maximum.

SUMMARY OF THE INVENTION

Therefore, an object of the present invention is to provide a scroll type compressor provided with a rotation preventing means for a movable scroll element, which includes a plurality of pin and ring assemblies, each having a pair of pins mounted on a compressor housing and the scroll element, respectively, and a ring therein, and which further includes an arrangement wherein a substantially identical load is evenly applied to each pair of pins of the plurality of pin and ring assemblies.

In accordance with an aspect of the present invention, there is provided a scroll type compressor for compressing a fluid which comprises:

a housing unit for forming an outer framework of the compressor and provided with an inlet port for introducing the fluid before compression into the compressor and an outlet for delivering the fluid after compression;

a shaft rotatably supported in the housing unit and having an inner portion thereof forming a drive part of the compressor;

a stationary scroll element provided with a stationary end plate secured to the housing unit for forming a sealed cavity between the housing unit and the stationary end plate, and a stationary spiral member formed on one end of the end plate and arranged in the sealed cavity;

a movable scroll element provided with a movable end plate having an inner end face facing the sealed cavity and an outer end face opposite to the inner end face on which a flange portion operatively connected to the drive part of the shaft, and a movable spiral member formed on the inner end face of the movable end plate, the movable spiral member being movably engaged with the stationary spiral member and defining a compression chamber between the stationary and movable scroll elements which has an initial volume reducible to compress the fluid; and a rotation preventing unit for preventing rotation of the movable scroll element about its own axis and permitting the movable scroll element to implement an orbital motion about a given axis in response to rotation of the shaft, the rotation preventing unit including:

a plurality of scroll side pins mounted in the outer end face of the movable end plate so as to project from the outer end face, and having a cylindrical face thereof, respectively;

a plurality of housing side pins mounted in the housing unit so as to project toward the plurality of scroll side pins and having a cylindrical face thereof, respectively, the plurality of housing pins and the scroll side pins forming a plurality of pairs of cooperative scroll and housing side pins; and a plurality of ring elements, each of the ring elements being arranged to be engaged with each of the plurality of pairs of cooperative scroll and housing side pins in such a manner that an inner wall of the ring element is in contact with the cooperative scroll and housing side pins to thereby prevent rotation of the movable scroll element.

The scroll type compressor is characterized in that when the compression chamber has a reduced volume of 10 through 22% of the initial volume of the compression chamber immediately after completion of sucking of the fluid before compression, at least two of the plurality of scroll side pins (A and B) of the rotation preventing unit are arranged to be symmetrical with one another with respect to a line $L_2$ which passes through a rotating center $O_R$ about which the movable scroll element rotates and is perpendicular to a different line $L_1$ which passes through the rotating center $O_R$ about which the movable scroll element rotates and an orbiting center $O_S$ of the movable scroll element. Further, the above-mentioned two of the plurality of scroll side pins are arranged on a leading side to the cooperating housing side pins, respectively, in a direction corresponding to a direction of rotation of the movable scroll element about the rotating center $O_R$. Thus, when a load caused by the maximum moment acting on the movable scroll element during the operation of the compressor acts on paired scroll and housing side pins of the rotation preventing unit, the load is evenly applied to each pair of scroll and housing side pins without occurrence of concentration of the load to only one pair of scroll and housing side pins. Thus, the rotation preventing unit can be prevented from being broken.

Preferably, the rotation preventing unit comprises an even number of paired cooperative scroll side and housing side pins and a corresponding even number of ring elements arranged in a region capable of contributing to prevention of rotation of the movable scroll element, with respect to the line $L_1$ extending to pass through both the rotating center $O_R$ and the orbiting center $O_S$ of the movable scroll element.

Further, the plurality of scroll side pins of the rotation preventing unit are arranged equiangularly on a circle having a center located at the rotating center $O_R$ of the movable scroll element, and wherein the plurality of housing side pins of the rotation preventing unit are arranged equiangularly on a different circle having a center thereof located at the orbiting center $O_S$ of the movable scroll element.

The rotation preventing unit may comprise at the most four pairs of cooperative scroll and housing side pins and at the most four ring elements engaged with the four pairs of cooperative scroll and housing side pins.

When the compression chamber has a reduced volume at 10 through 22% of said initial volume of said compression chamber immediately after completion of sucking of the fluid before compression, the two scroll side pins having respective centers thereof may be arranged in such a manner that two lines passing through the respective centers of the two scroll side pins and the rotating center $O_R$ of the movable scroll element and the line $L_2$ passing through the rotating center $O_R$ of the movable scroll element and being perpendicular to the line $L_1$ passing through both rotating center $O_R$ and orbiting center $O_S$ of the movable scroll element define two symmetrical angles with respect to the line $L_2$, the symmetrical angles being substantially +45 degrees and −45 degrees, respectively.

In accordance with another aspect of the present inventions, there is provided a scroll type compressor for compressing a fluid which comprises:

a housing unit for forming an outer framework of the compressor and provided with an inlet port for introducing the fluid before compression into the compressor and an outlet for delivering the fluid after compression;

a shaft rotatably supported in the housing and having an inner portion thereof forming a drive part of the compressor;

a stationary scroll element including a stationary end plate secured to the housing unit for forming a sealed cavity between the housing unit and the stationary end plate, and a stationary spiral member formed on one end of the end plate and arranged in the sealed cavity;

a movable scroll element including a movable end plate having an inner end face facing the sealed cavity and an outer end face opposite to the inner end face on which a flange portion operatively connected to the drive part of the shaft, and a movable spiral member formed on the inner end face of the movable end plate, the movable spiral member being movably engaged with the stationary spiral member and defining a compression chamber between the stationary and movable scroll elements which has an initial volume reducible to compress the fluid; and a rotation preventing unit for preventing rotation of the movable scroll element about its own axis and permitting the movable scroll element to implement an orbital motion about a given axis in response to rotation of the shaft, the rotation preventing unit including:

a plurality of scroll side pins mounted in the outer end face of the movable end plate so as to project from the outer end surface, and having a cylindrical face thereof, respectively; and a plurality of housing side pins mounted in the housing unit so as to project toward the plurality of scroll side pins and having a cylindrical surface thereof, respectively, the plurality of housing pins and the scroll side pins being arranged in such a manner that the cylindrical surfaces of the plurality of scroll side pins and the plurality of housing side pins being in constant contact with one another to thereby prevent rotation of the movable scroll element during the operation of the compressor.

The above-described scroll type compressor is characterized in that when the compression chamber has a reduced volume of 10 through 22% of the initial volume of the compression chamber immediately after completion of sucking of the fluid before compression, at least two of the plurality of scroll side pins of the rotation preventing unit are arranged to be symmetrical with one another with respect to a line $L_2$ which passes through a rotating center $O_R$ about which the movable scroll element rotates and is perpendicular to a different line $L_1$ which passes through the rotating center $O_R$ about which the movable scroll element rotates and an orbiting center $O_S$ of the movable scroll element.

The housing side pins cooperative with the two scroll side pins are arranged on a leading side to the two scroll side pins, respectively, in a direction corresponding to a direction of rotation of the movable scroll element about the rotating center $O_R$. Thus, when a load caused by the maximum moment acting on the movable scroll element during the operation of the compressor acts on paired scroll and housing side pins of the rotation preventing unit, the load is evenly applied to each pair of scroll and housing side pins without occurrence of concentration of the load to only one pair of scroll and housing side pins. Thus, the rotation preventing unit can be prevented from being broken.

BRIEF DESCRIPTION OF THE DRAWINGS

The above and other objects, features and advantages of the present invention will be made more apparent from the ensuing description of the preferred embodiments thereof with reference to the accompanying drawings wherein.

DESCRIPTION OF THE PREFERRED EMBODIMENTS (First Embodiment)

Figure 1:
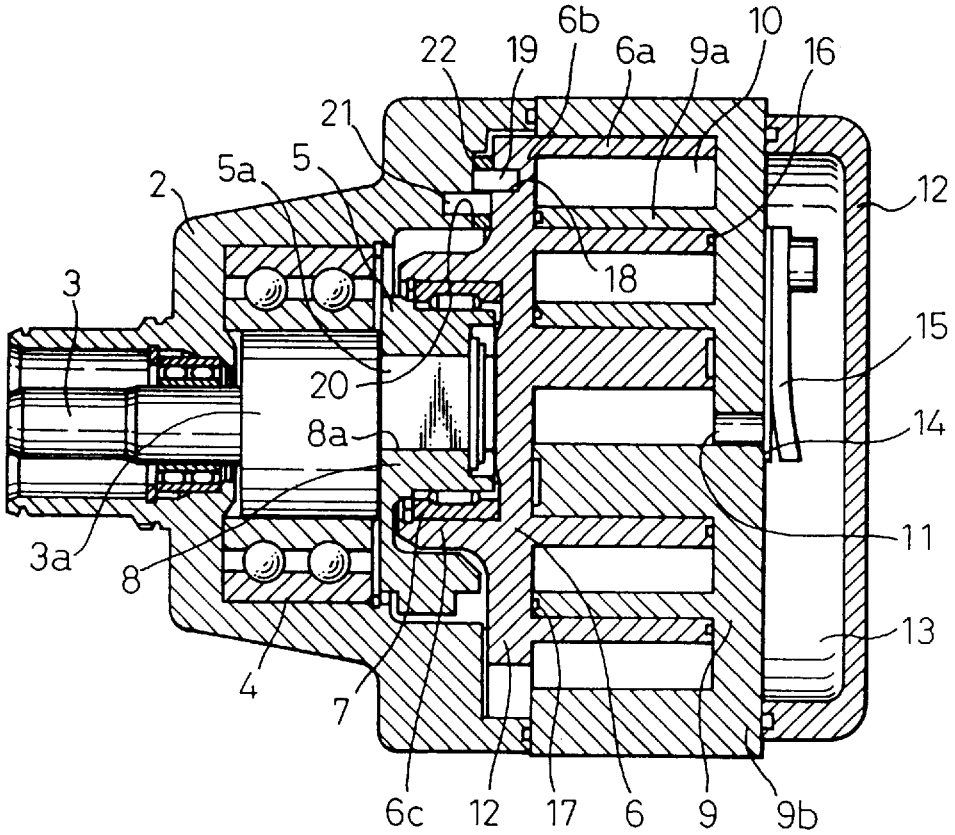
FIG. 1 is a cross-sectional view of a scroll type compressor in which a rotation preventing unit according to a first embodiment of the present invention may be incorporated.
Figure 2:
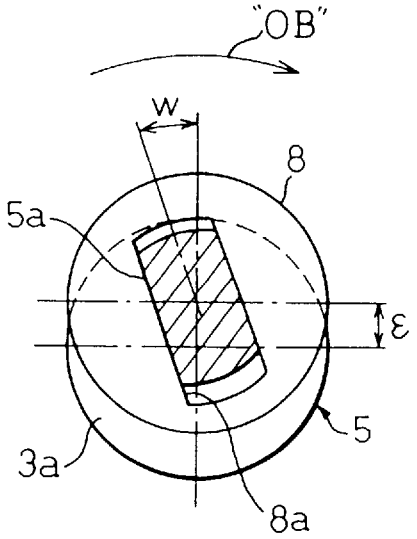
FIG. 2 is a partial cross-sectional view of a crank portion of the compressor of FIG. 1.

FIG. 1 illustrates a general construction of a scroll type fluid compressor 1 including a stationary scroll element and a movable scroll element. The compressor 1 has a front housing 2 having a central portion thereof in which an anti-friction bearing 4 is mounted to rotatably support a crank or drive shaft 3. The crank shaft 3 has a small diameter portion extending outwardly toward a central opening of the front housing 2, a large diameter portion 3*a* concentric and integral with the small diameter portion, and fitted in the inner race of the bearing 4, and a drive key 5*a* integral with the large diameter portion 3*a* and arranged to be eccentric with the central axis of the large diameter portion 3*a* of the crank shaft 3. A movable scroll element 6 having a spiral member 6*a* spirally extending around a given axis is mounted in an axially inner end portion of the front housing 2. The movable scroll element 6 also has a movable end plate 6*b* having an inner end face located far from the drive key 5*a* and the opposite outer end face located close to the large diameter portion 5*a*. The spiral member 6*a* is integrally secured to the inner end face of the end plate 6*b*. The movable scroll element 6 further has a boss portion 6*c* secured to a central portion of the outer end face of the end plate 6*b*. The boss portion 6*c* of the movable scroll element 6 has a bearing 7 mounted in a central bore portion formed therein, and having a bush 8 forming an inner race thereof. The bush 8 has a key way 8*a* in which the drive key 5*a* of the crank shaft 3 is securely keyed. The key way 8*a* and the drive key 5*a* have substantially rectangular cross-sections, as best shown in FIG. 2. At this stage, in the cross section of the key way 8*a* and the drive key 5*a*, as shown in FIG. 2, the longitudinal length of the rectangular shaped key way 8*a* of the bush 8 is larger than that of the rectangularly shaped drive key 5*a* of the crank shaft 3. Thus, the drive key 5*a* is slidably movable in the key way 8*a* of the bush 8 in a direction corresponding to the longitudinal direction of the key way 8*a*.

It should be noted that, as shown in FIG. 2, the key way 8*a* of the bush 8 and the drive key 5*a* of the crank shaft 3 are arranged in such a manner that the common center line of the key way 8*a* and the drive key 5*a* is turned by an angle "w" from an axis along which an eccentricity "$\epsilon$" occurs between the bush 8 and the large diameter portion 3*a* of the drive shaft 3. The above-mentioned turning of the center line of the key way 8*a* and the drive key 5*a* is given in a direction opposite to the direction "OB" in which the movable scroll element 6 performs an orbital motion. The drive key 5*a*, the bush 8, and the key way 8*a* form a crank portion 5 for causing the orbital motion of the movable scroll element 6 with respect to a later-described stationary scroll element.

The scroll type compressor 1 further includes a stationary scroll element 9 provided with a spiral member 9*a*, and a stationary end plate 9*b*. The stationary scroll element 6 is secured to the inner end of the front housing 2 by means of screw bolts (not shown in FIG. 1) so as to define an inner cavity 10 in which the movable scroll element 6 performs the orbital motion with respect to the stationary scroll element 9 about an axis of rotation of the crank shaft 3.

The stationary end plate 9*b* of the stationary scroll element 9 is centrally provided with a discharge port 11 for discharging a compressed fluid from compression chambers defined by the movable and stationary spiral members 6*a* and 9*a*.

The discharge port 11 is in communication with a large cavity defined by the end of the stationary scroll element 9 and a rear housing 12. The large cavity is provided so as to act as a muffling chamber for muffling the pulsations in the discharged fluid, and accordingly, it is referred to as a muffling chamber 13.

A check valve 14 made of spring steel plate is arranged in the muffling chamber 13 so as to open and close the discharge port 11 on the side adjacent to the muffling chamber 13. The check valve 14 prevents the discharged fluid from reversely flowing from the muffling chamber 13 into the compression chambers. As clearly shown in FIG. 1, the check valve 14 is attached to an end face of the stationary end plate 9*b*, facing the muffling chamber 13. The check valve 14 is backed up by a valve support 15 acting so as to limit the opening movement of the check valve 14.

The movable spiral members 6*a* of the movable scroll element 6 and the stationary spiral member 9*a* of the stationary scroll element 9 are provided with sealing grooves formed in the frontmost ends thereof in which a tip sealing element 16 is fitted so as to hermetically seal the compression chambers defined between both movable and stationary scroll elements 6 and 9. The tip sealing element 16 is made of synthetic resin material, typically, polytetrafluoroethylene.

The outer end face of the end plate 6*b* of the movable scroll element 6 is provided with a plurality of circular bores 18 formed therein at an outer portion of the element 6 for receiving press-fitted cylindrical pins 19 which will be hereinafter referred to as scroll side pins. In the described embodiment, four circular holes 18 are arranged so as to receive the four cylindrical scroll side pins 19, as shown in FIG. 3.

On the other hand, the end of the front housing 2 facing the end plate 6*b* of the movable scroll element 6 is provided with a plurality of circular holes 20 at positions disposed to be not in alignment with but close to the holes 18 of the movable scroll element 6. Thus, in the described embodiment, four circular holes 20 for receiving cylindrical pins 21 press-fitted therein. The cylindrical pins 21 will be hereinafter referred to as housing side pins. It should be noted that one of the scroll side pins 19 and one of the housing side pins 21, which are disposed to be close to each other, form a pair of rotation preventing pins of the rotation preventing means. Namely, in the described embodiment of FIG. 3, four pairs of rotation preventing pins are arranged equiangularly in the outer portion of the movable end plate 6*b* and the end face of the front housing 2. The scroll side pins 19 and the housing side pins 21 are made of wear-resistant and mechanically strong metallic material, for example, a high-carbon chromium bearing steel. The pair of scroll side and housing side pins 19 and 21 are engaged with a ring element 22 so that the former pins 19 and 21 are enclosed by the latter ring element 22. The ring element 22 is made of a wear-resistant and mechanically strong metallic material similar to the material of the scroll side and housing side pins 19 and 21, e.g., a high-carbon chromium bearing steel.

Figure 3:
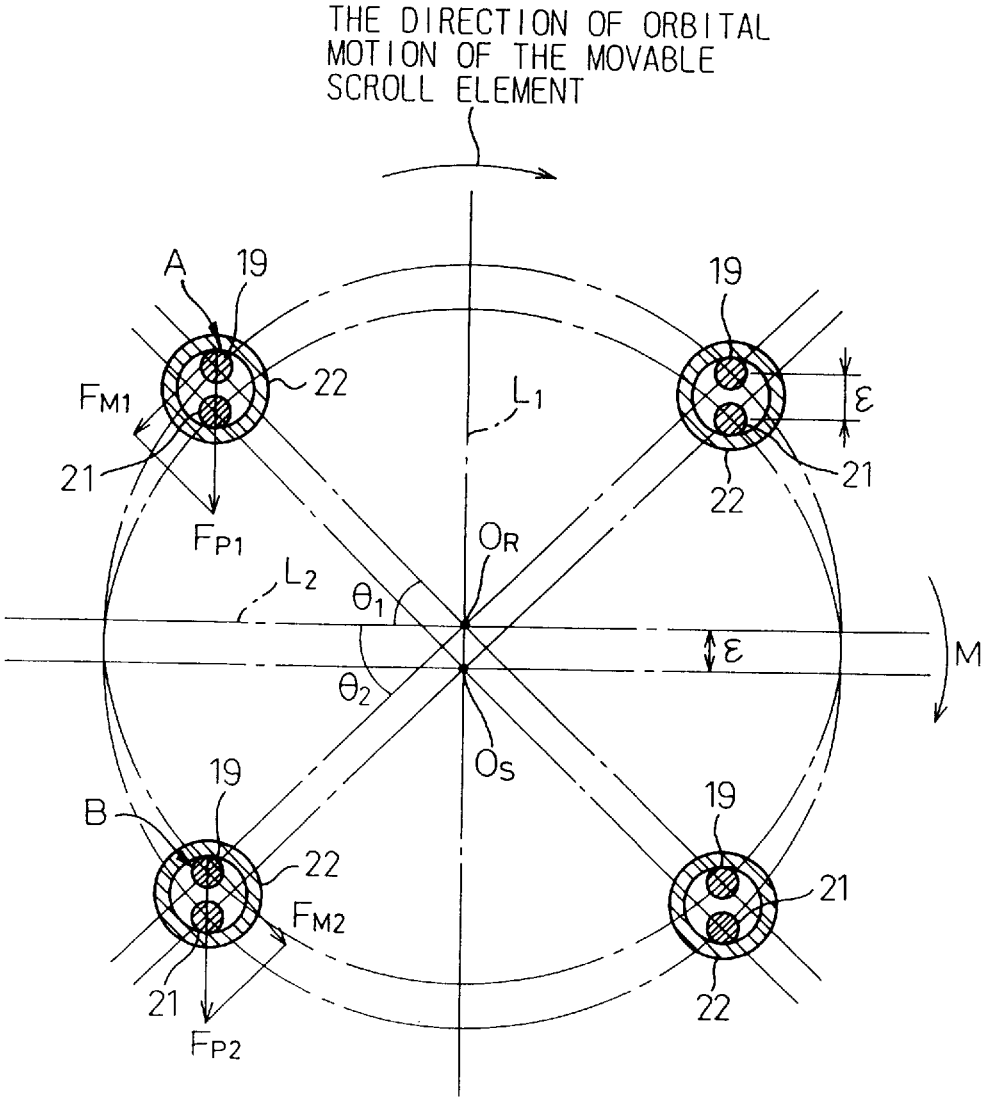
FIG. 3 is an enlarged cross-sectional view of the rotation preventing means, illustrating an arrangement of the pins mounted on the movable scroll element, the pins mounted on the compressor housing, and ring elements engaged with the pair of pins.

It should be noted that FIG. 3 illustrates the relative positional relationship between the four pairs of pin and ring assemblies 19, 21, and 22, and that of paired pins 19 and 21 and the ring element 22 of each pair of pin and ring assembly. Thus, the boss portion 6*c* of the movable scroll element 6, the bearing 7, and the crank portion 5 are omitted for the sake of brevity.

Figure 4:
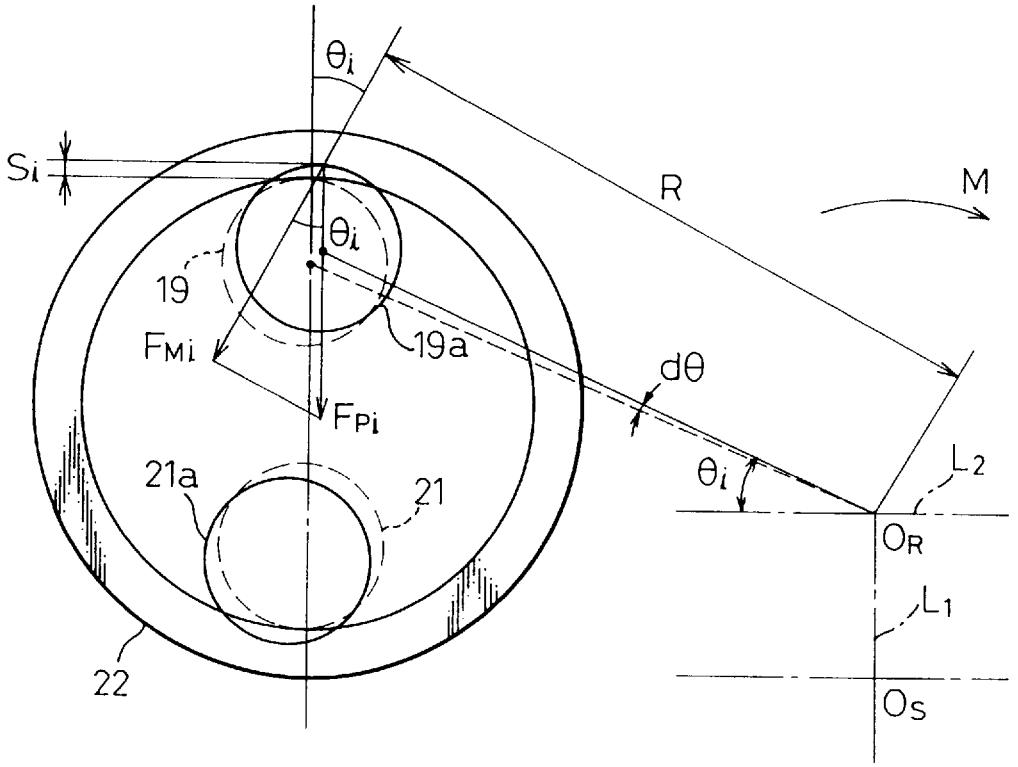
FIG. 4 is a schematic view of one pair of the pins and the associated ring of the rotation preventing unit of the embodiment of the present invention, illustrating how a load is applied to the respective pins and the ring.

The description of the rotation preventing means for the movable scroll element 6 will be provided hereinbelow, with reference to FIGS. 3 and 4. The rotation preventing means includes a plurality of pin and ring assemblies, i.e., four sets of housing and scroll side pins 19, 21 and ring element 22 in the illustrated embodiment. In FIG. 4, one of the four pin and ring assemblies is typically shown, in relation to the later-described orbiting center "$O_S$" of the scroll element 6 and the rotating center "$O_R$" of the bearing 7. During the operation of the scroll type compressor, a mechanical moment "M" acts on the movable element 6 so as to rotate it about the rotating center "$O_R$" of the bearing 7. In the illustrated embodiment, it is assumed that the mechanical moment "M" acts in a clockwise direction. The pair of scroll and housing side pins 19 and 21 of the rotation preventing means before they are acted by the mechanical moment "M" are shown by broken lines in FIG. 4. When the mechanical moment "M" on the movable scroll element 6, the scroll side pin 19 secured to the scroll element 6 is in turn moved to a position shown by a solid line in FIG. 4. Then, if the housing side pin 21 secured to the inner end of the front housing 2 is similarly moved to a position shown by a solid line, the ring element 22 is not locked by both pins 19 and 21. Nevertheless, since the housing side pin 21 is fixed, the ring element 22 is locked by the pins 19 and 21 and acts so as to prevent the rotation of the movable scroll element 6 about its own axis which coincides with the rotating center "$O_R$" of the bearing 7.

When the rotation preventing means acts so as to prevent rotation of the movable scroll element 6, the scroll and housing side pins 19, 20, and the ring element 22 take a relative positional relationship therebetween as described below.

Namely, when the volume of each of the compression chambers defined between the movable and stationary scroll elements 6 and 9, reaches 10 through 22% of the volume taken by each compression chamber immediately after the completion of suction of the fluid, at least two of the four scroll side pins 19, i.e., the two pins 19 located at positions designated by "A" and "B" in FIG. 3 are arranged symmetrically with one another with respect to a line "$L_2$" which passes the rotating center "$O_R$" about which the movable scroll element 6 is urged to rotate, and is perpendicular to a line "$L_1$" which passes both the rotating center "$O_R$" and the orbiting center "$O_S$" of the movable scroll element 6. Thus, angles "$\theta_1$" and "$\theta_2$" of the symmetrically arranged two pins 19 located at positions "A" and "B", with respect to the line "$L_2$" can be considered to be the same ("$\theta_1$"="$\theta_2$"). In the described embodiment having four sets of pin and ring element assemblies, the angles "$\theta_1$" and "$\theta_2$" of the symmetrically arranged two pins 19 are 45 degrees, respectively.

Further, the pins 19 located at the positions "A" and "B" are located on a circle having the center thereof positioned at the rotating center $O_R$ of movable scroll element 6 and arranged on the leading side with respect the respective housing side pins 20 pairing with the two scroll side pins 19 when viewing in a direction in which the rotation of the movable scroll element 6 about its own axis occurs.

At this stage, the amount of rotation of the movable scroll element 6 about its own axis and the positions of the scroll side pins 19 of the rotation preventing means can be described in detail with reference to FIG. 4.

First, the engineering meanings of respective symbols used in the description provided hereinbelow will be defined as set forth below.

M: a mechanical moment acting on the movable scroll element 6 so as to rotate the element 6 about its own axis $d_1$: the diameter of the scroll side pin 19

$d_2$: the diameter of the housing side pin 21

D: the inner diameter of the ring element 22

$\epsilon$: a radius of an orbital motion of the movable scroll element 6 (a distance between the rotating center "$O_R$" of the movable scroll element 6 and the orbiting center "$O_S$" of the same element 6)

R: a distance from the center of the scroll side pin 19 to the rotating center "$O_R$" of the movable scroll element 6

$L_1$: a line which passes through both of the rotating center "$O_R$" and the orbiting center $O_S$ of the movable scroll element 6

$L_2$: a line which passes through the rotating center "$O_R$" of the movable scroll element 6 and extends perpendicularly to the line $L_1$ $\theta_i$: an angle (radian) between a line passing through the center of any one of scroll side pins 19 and the rotating center "$O_R$" and the line $L_2$ where the suffix "i" indicates the number of any one of the plurality (n) of scroll side pins 19 ($0 \leqq \theta \leqq \pi/2$)

$d\theta$: an angular amount (radian) of rotation of the movable scroll element 6 about its own axis or the axis of rotation of the bearing 7

$F_{Pi}$: a load acting on each of the scroll side pins 19

$F_{Mi}$: a tangential component of the load $F_{Pi}$ $S_i$: an amount of movement of the scroll side pin 19 upon being acted by the load $F_{Pi}$ k: a resistance against a deformation exhibited by each of the scroll side pins 19 and the ring element 22

At this stage, it should be noted that the angle "$d\theta$" of rotation of the movable scroll element 6 about its own axis is sufficiently smaller than the distance "R" from the center of the scroll side pin 19 to the rotating center "$O_R$" of the movable scroll element 6. It should further be noted that the deformation resistance "k" of the scroll side pins 19 and the ring element 22 may be considered to be equivalent to one another. It should still further be noted that during the consideration of a load applied to each of the pairs of pin and ring assemblies made hereinbelow, manufacturing errors of the scroll and housing side pins 19 and 21, and of the housing side pin 22 may be ignored, and that the paired rings 19 and 21 are arranged so as to be in constant contact with the inner wall of the associated ring element 22.

The description of the calculation for obtaining a load $F_{Pi}$ acting on each of the scroll side pins 19 of the rotation preventing means is provided below with reference to FIG. 4.

The amount of movement $S_i$ of the scroll side pin 19 on which a load $F_{Pi}$ acts can be defined by an equation as set forth below.

$$S_i = R \times d\theta \times \cos\theta_i \quad (1)$$

The load $F_{Pi}$ acting on each of the scroll side pins 19 can be obtained from the equation (1), and defined by an equation (2) as set forth below.

$$F_{Pi} = k \times S_i = k \times R \times d\theta \times \cos\theta_i \quad (2)$$

The tangential component of the load $F_{Pi}$ can be defined by an equation (3) as set forth below.

$$F_{Mi} = F_{Pi} \times \cos\theta_i = k \times R \times d\theta \times \cos^2\theta_i \quad (3)$$

Further, the mechanical moment M acting on the movable scroll element 6 can be defined by an equation (4) below, when a balance between M and $F_{Mi}$ is taken into consideration.

$$M = F_{M1} \times R + F_{M2} \times R + \cdots + F_{Mn} \times R \quad (4)$$

The load $F_{Pi}$ can be calculated from the above equations (2) through (4), and defined as an equation (5) set forth below.

$$F_{Pi} = (M \times \cos\theta_i)/(R \times (\cos^2\theta_1 + \cos^2\theta_2 + \mathrm{COS}^2\theta_3 + \cdots + \cos^2\theta_i + \cdots + \mathrm{COS}^2\theta_n))$$

At this stage, it should be understood that the calculation of the load $F_{Pi}$ is carried out with respect to only the scroll and housing side pins 19 and 21 which work as the rotation preventing means at the moment when the calculation is carried out, namely the pins located on the left hand side of the line $L_1$ in FIG. 3.

From the foregoing description, it will be understood that when two scroll side pins 19 are arranged to be symmetrical with one another with respect to the line $L_2$ which passes through the rotating center $O_R$ of the movable scroll element 6 and is perpendicular to the line $L_1$ which passes through the rotating center $O_R$ and the orbiting center $O_S$ of the movable scroll element 6, the load $F_{Pi}$ cannot be concentrated on only a single scroll side pin 19. Namely, if the load $F_{Pi}$ acting on at least two respective scroll side pins 19 located at the positions A and B in FIG. 3 are arranged to have an equal value of cosine, the load acting on the pin located at the position A and that acting on the pin located at the position B can cancel one another, and accordingly, the concentration of the load $F_{Pi}$ on only one of the pins 19 does not occur. Further, the load $F_{Pi}$ acting on any one of the two pins 19 can be very small. As a result, if such small load condition can be constantly maintained during the operation of the scroll type compressor, the size of the compressor itself can be reduced.

(Second Embodiment)

Figure 5:
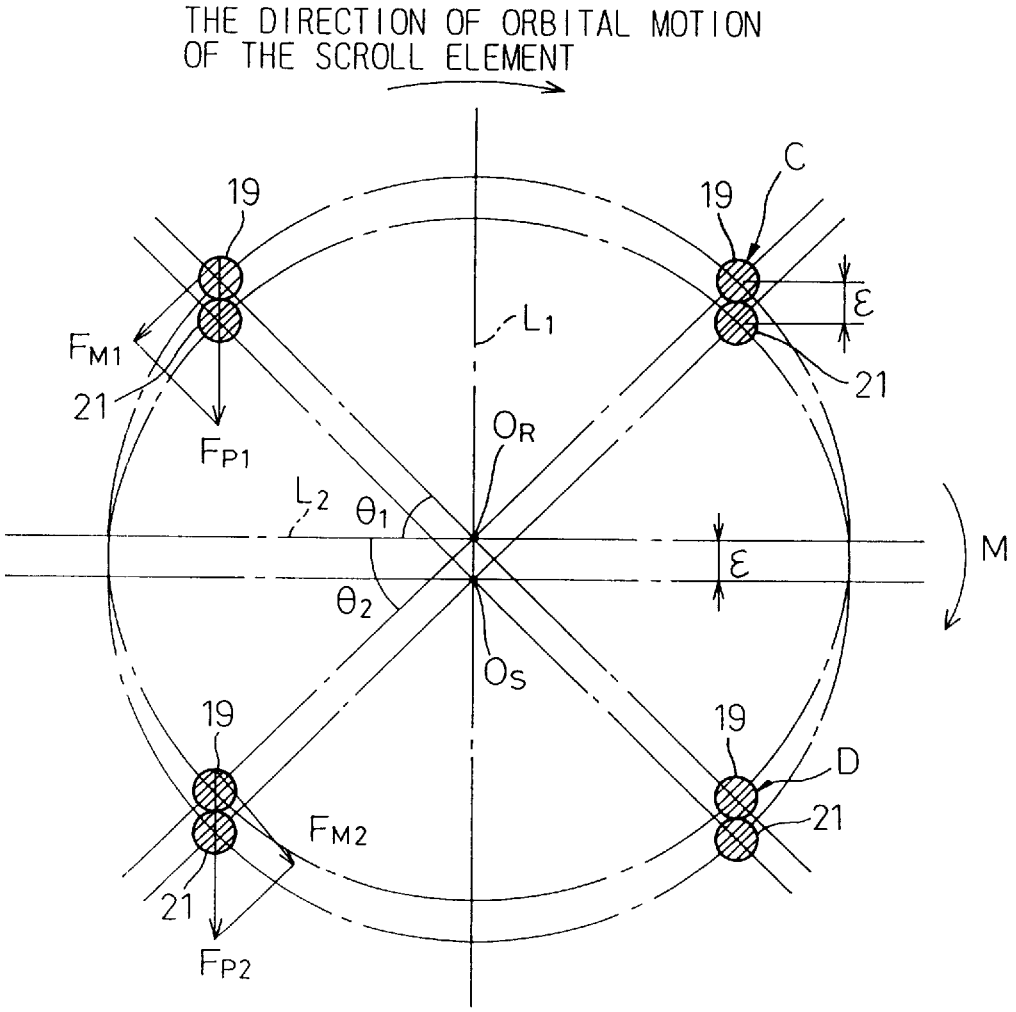
FIG. 5 is a similar view to FIG. 3, but illustrating an arrangement of the pins mounted on the movable scroll element, the pins mounted on the compressor housing, and ring elements engaged with the pair of pins of the rotation preventing means according to the second embodiment of the present invention.
Figure 6:
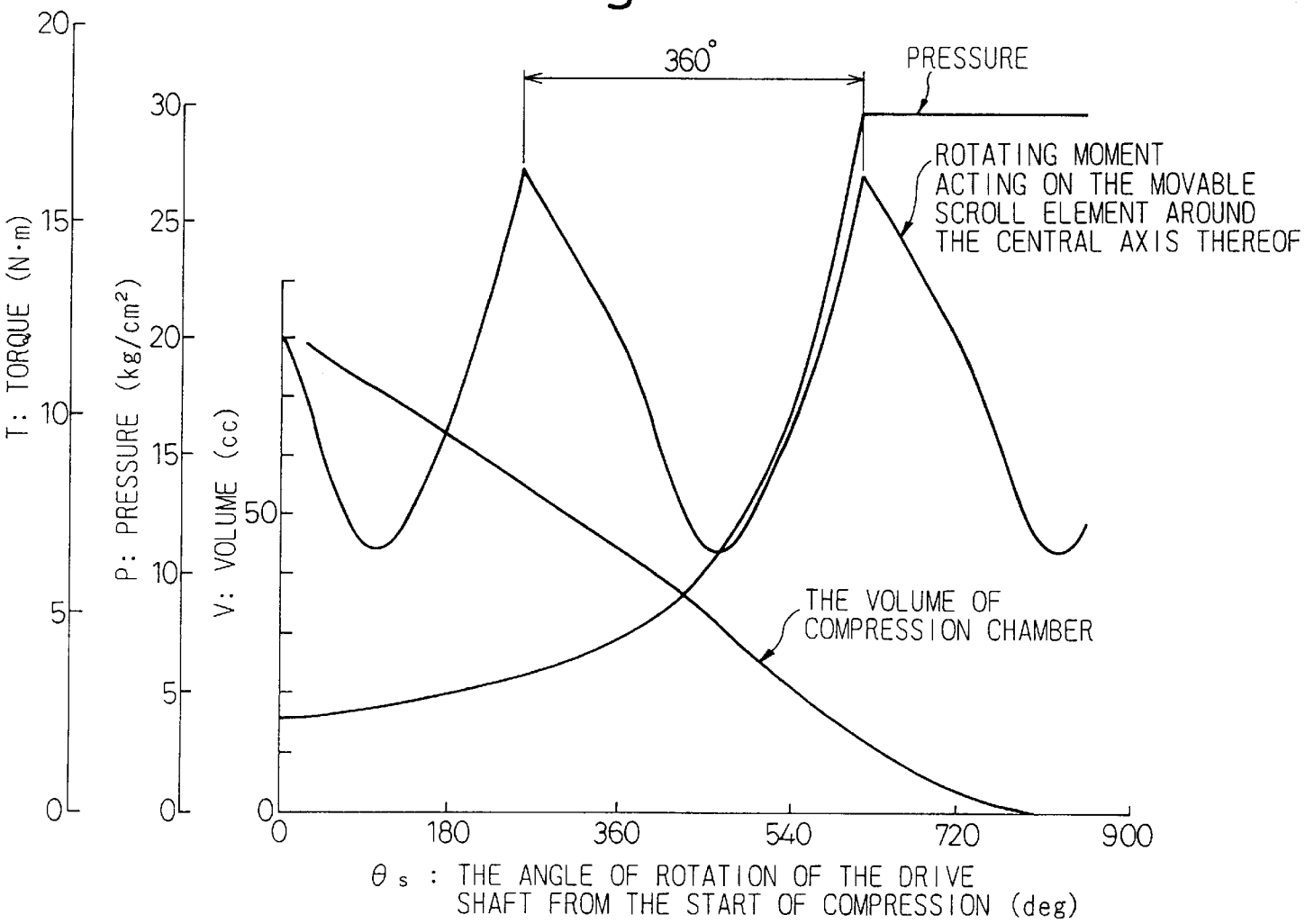
FIG. 6 is a graph indicating a relationship between the moment for causing a rotation of the movable scroll element about its own axis and the angle of rotation of a drive shaft of a scroll type compressor, and also indicating a relationship between the pressure condition in the compression chambers and the angle of rotation of the same drive shaft.

In the described first embodiment, the rotation preventing means for the movable scroll element 6 includes a plurality of pin and ring assemblies, each including a pair of scroll side and housing side pins 19, 21 and a ring element 22. However, it should be understood that the present invention is equally applicable to a rotation preventing means having no ring element. More specifically, a different type of rotation preventing means for a scroll type compressor as shown in FIG. 5 includes only a plurality of pairs of scroll and housing side pins 19 and 21. At this stage, the scroll side pins 19 of the rotation preventing means should be arranged so as to be symmetrical with one another with respect to the line $L_2$ which passes through the rotating center "$O_R$" of the movable scroll element 6 and is perpendicular to the line $L_1$ which passes through the rotating center "$O_R$" and the orbiting center "$O_S$" of the movable scroll element 6. Further, the housing side pins 21 which are paired with the scroll side pins 19 located at positions C and D of FIG. 5 should be arranged on the leading side to the paired scroll side pins 19 in a direction of the rotation of the movable scroll element about the center $O_R$. Thus, rotation of movable scroll element 6 will be prevented by scroll side pins 19 labeled C and D contacting housing side pins 21. It should be noted that in FIG. 5, the illustration of boss portion 6*c* of the movable scroll element 6, the bearing 7, and the crank portion 5 are omitted for the sake of brevity.

From the foregoing description, it should be understood that in accordance with the present invention, the rotation preventing means can avoid concentration of a load to any one of the plurality of scroll side pins thereof, and thus, the breakage of the rotation preventing means can be surely prevented.

Many variations and modifications will occur to persons skilled in the art without departing from the spirits and scope of the invention defined in the accompanying claims.

What we claim:

1. A scroll type compressor for compressing a fluid comprising:

a housing means for forming an outer framework of the compressor and provided with an inlet port for introducing the fluid before compression into the compressor and an outlet for delivering the fluid after compression;

a shaft rotatably supported in said housing means and having an inner portion thereof forming a drive part of the compressor;

a stationary scroll element provided with a stationary end plate secured to said housing means for forming a sealed cavity between said housing means and said stationary end plate, and a stationary spiral member formed on one end of said end plate and arranged in the sealed cavity;

a movable scroll element provided with a movable end plate having an inner end face facing the sealed cavity and an outer end face opposite to said inner end face on which a flange portion is operatively connected to said drive part of said shaft, and a movable spiral member formed on said inner end face of said movable end plate, said movable spiral member being movably engaged with said stationary spiral member and defining a compression chamber between said stationary and movable scroll elements which has an initial volume reducible to compress the fluid; and a rotation preventing means for preventing rotation of said movable scroll element about its own axis and permitting said movable scroll element to implement an orbital motion about a given axis in response to rotation of said shaft, said rotation preventing means including:

a plurality of scroll side pins mounted in said outer end face of said movable end plate so as to project from said outer end face, each having a cylindrical surface;

a plurality of housing side pins mounted in said housing means so as to project toward said plurality of scroll side pins, each having a cylindrical surface, said plurality of housing side pins and said scroll side pins forming a plurality of pairs of cooperative scroll and housing side pins; and a plurality of ring elements, each of said ring elements being arranged to be engaged with each of the plurality of pairs of cooperative scroll and housing side pins in such a manner that an inner wall of said ring element is in contact with said cooperative scroll and housing side pins to thereby prevent rotation of said movable scroll element, wherein when said compression chamber has a reduced volume at 10 through 22% of the initial volume of said compression chamber immediately after completion of sucking of the fluid before compression, at least two circumferentially adjacent pins of said plurality of scroll side pins of said rotation preventing means are arranged to be symmetrical with one another with respect to a first line which passes through a rotating center about which the movable scroll element rotates, the first line being perpendicular to a second line which passes through the rotating center about which said movable scroll element rotates and an orbiting center of said movable scroll element, at least two of said plurality of scroll side pins being arranged on a leading side to said cooperating housing side pins, respectively, in a direction corresponding to a direction of rotation of said movable scroll element about the rotating center, whereby the two circumferentially adjacent pins are subjected to substantially equal loads when a rotational moment acting on the movable scroll element increases to a maximum.

2. A scroll type compressor according to claim 1 wherein when said compression chamber has a reduced volume of 10 through 22% of said initial volume of said compression chamber immediately after completion of sucking of said fluid before compression, said rotation preventing means comprises an even number of said paired cooperative scroll side and housing side pins and a corresponding even number of said ring elements arranged in a region capable of contributing to prevention of rotation of said movable scroll element, with respect to said second line extending to pass through both the rotating center and the orbiting center of said movable scroll element.

3. A scroll type compressor according to claim 1, wherein said plurality of scroll side pins of said rotation preventing means are arranged equiangularly on a circle having a center located at said rotating center of said movable scroll element, and wherein said plurality of housing side pins of said rotation preventing means are arranged equiangularly on a different circle having a center thereof located at said orbiting center of said movable scroll element.

4. A scroll type compressor according to claim 1 wherein said rotation preventing means comprises at the most four pairs of cooperative scroll and housing side pins and at the most four ring elements engaged with said four pairs of cooperative scroll and housing side pins.

5. A scroll type compressor according to claim 1 wherein said rotation preventing means comprises at least three pairs of cooperative scroll and housing side pins and at least three ring elements engaged with said three pairs of cooperative scroll and housing side pins.

6. A scroll type compressor according to claim 1 wherein when said compression chamber has the reduced volume at 10 through 22% of said initial volume, said at least two scroll side pins having respective centers thereof are arranged in such a manner that two lines passing through said respective centers of said two scroll side pins and the rotating center of said movable scroll element and said first line passing through the rotating center of said movable scroll element and being perpendicular to said second line passing through both rotating center and orbiting center of said movable scroll element define two symmetrical angles being substantially +45 degrees and −45 degrees, respectively.

7. A scroll type compressor according to claim 1, wherein said drive part of the compressor provided by said shaft comprises a crank portion including a drive key member integral with said shaft and arranged to be eccentric from an axis of rotation of said shaft, and a bush member having a key groove in which said drive key is radially slidably fitted.

8. A scroll type compressor for compressing a fluid comprising:

a housing means for forming an outer framework of the compressor and provided with an inlet port for introducing the fluid before compression into the compressor and an outlet for delivering the fluid after compression;

a shaft rotatably supported in said housing means and having an inner portion thereof forming a drive part of the compressor;

a stationary scroll element provided with a stationary end plate secured to said housing means for forming a sealed cavity between said housing means and said stationary end plate, and a stationary spiral member formed on one end of said end plate and arranged in the sealed cavity;

a movable scroll element provided with a movable end plate having an inner end face facing the sealed cavity and an outer end face opposite to the inner end face on which a flange portion is operatively connected to the drive part of said shaft, and a movable spiral member formed on said inner end face of said movable end plate, said movable spiral member being movably engaged with said stationary spiral member and defining a compression chamber between said stationary and movable scroll elements which has an initial volume reducible to compress said fluid; and a rotation preventing means for preventing rotation of said movable scroll element about its own axis and permitting said movable scroll element to implement an orbital motion about a given axis in response to rotation of said shaft, said rotation preventing means including:

a plurality of scroll side pins mounted in said outer end face of said movable end plate so as to project from said outer end face, each having a cylindrical surface; and a plurality of housing side pins mounted in said housing means so as to project toward said plurality of scroll side pins and having a cylindrical surface, said plurality of housing side pins and said scroll side pins being arranged in such a manner that said cylindrical surfaces of said plurality of housing side pins are in constant contact with one another to thereby prevent rotation of said movable scroll element during the operation of said compressor, wherein when said compression chamber has a reduced volume at 10 through 22% of the initial volume of said compression chamber immediately after completion of sucking of said fluid before compression, at least two circumferentially adjacent sins of said plurality of scroll side pins of said rotation preventing means are arranged to be symmetrical with one another with respect to a first line which passes through a rotating center about which said movable scroll element rotates, said first line being perpendicular to a second line which passes through the rotating center about which said movable scroll element rotates and an orbiting center of said movable scroll element, said housing side pins cooperative with said at least two scroll side pins being arranged on a leading side to said two scroll side pins, respectively, in a direction corresponding to a direction of rotation of said movable scroll element about said rotating whereby the two circumferentially adjacent pins are subjected to substantially egual loads when a rotational moment acting on the movable scroll element increases to a maximum.

9. A scroll type compressor according to claim 8 wherein, when said compression chamber has the reduced volume at 10 through 22% of said initial volume, said rotation preventing means comprises an even number of said paired cooperative scroll side and housing side pins arranged in a region capable of contributing to prevention of rotation of said movable scroll element, with respect to said second line extending through the rotating center and the orbiting center of said movable scroll element.

10. A scroll type compressor according to claim 8, wherein said plurality of scroll side pins of said rotation preventing means are arranged equiangularly on a circle having a center located at said rotating center of said movable scroll element, and wherein said plurality of housing side pins of said rotation preventing means are arranged equiangularly on a different circle having a center thereof located at said orbiting center of said movable scroll element.

11. A scroll type compressor according to claim 8, wherein said rotation preventing means comprises at the most four pairs of cooperative scroll and housing side pins.

12. A scroll type compressor according to claim 8, wherein said rotation preventing means comprises at the least three pairs of cooperative scroll and housing side pins.

13. A scroll type compressor according to claim 8 wherein, when said compression chamber has the reduced volume at 10 through 22% of said initial volume of said compression chamber, said two scroll side pins having respective centers thereof are arranged in such a manner that two lines passing through said respective centers of said two scroll side pins and the rotating center of said movable scroll element and said first line passing through the rotating center of said movable scroll element and being perpendicular to said second line passing through both rotating center and orbiting center of said movable scroll element define two symmetrical angles with respect to said first line, said symmetrical angles being substantially +45 degrees and −45 degrees, respectively.

14. A scroll type compressor according to claim 8 wherein said drive part of the compressor provided by said shaft comprises a crank portion including a drive key member integral with said shaft and arranged to be eccentric from an axis of rotation of said shaft, and a bush member having a key groove in which said drive key is radially slidably fitted.

* * * * *